United States Patent [19]

Parrott

[11] Patent Number: 4,724,608

[45] Date of Patent: Feb. 16, 1988

[54] EXTRACTOR TOOL FOR BEARINGS, BUSHINGS AND THE LIKE

[76] Inventor: Ronald J. W. Parrott, Box 105, Franklin, Manitoba, Canada, R0J 0S0

[21] Appl. No.: 932,574

[22] Filed: Nov. 20, 1986

[51] Int. Cl.[4] ..... B21D 53/10

[52] U.S. Cl. ..... 29/724; 29/253; 29/259; 29/263; 29/264; 29/280; 29/282; 81/443; 81/444; 81/446

[58] Field of Search ..... 29/156.4 WL, 253, 256, 29/258, 259, 263, 264, 280, 282, 283, 724; 81/3.05, 53.2, 443, 444, 446

[56] References Cited

U.S. PATENT DOCUMENTS

| | | | |
|---|---|---|---|
| 1,363,934 | 12/1920 | Upton | 29/280 |
| 1,496,134 | 6/1924 | Rumgay | 29/280 |
| 2,290,427 | 7/1942 | Harrington | 29/265 |
| 2,614,318 | 10/1952 | McCord | 29/263 |
| 2,646,619 | 7/1953 | McCord | 29/263 |
| 2,671,263 | 3/1954 | Hamilton | 29/265 |
| 2,847,752 | 8/1958 | Simmons | 29/280 |
| 3,052,973 | 9/1962 | Williams | 29/265 |
| 3,611,540 | 10/1971 | Gibu | 29/263 |
| 4,050,136 | 9/1977 | Shultz | 29/724 |
| 4,207,664 | 6/1980 | Zoula | 29/264 |

FOREIGN PATENT DOCUMENTS

| | | | |
|---|---|---|---|
| 237589 | 8/1960 | Australia | 29/264 |
| 1115341 | 12/1955 | France | 29/263 |
| 15450 | of 1900 | United Kingdom | 29/263 |

*Primary Examiner*—Mark Rosenbaum
*Assistant Examiner*—Ronald S. Wallace
*Attorney, Agent, or Firm*—Stanley G. Ade; Adrian D. Battison; Murray E. Thrift

[57] ABSTRACT

A puller for spherical bushings comprises an inner puller body having a cylindrical outer surface so that it can be inserted into the bore of the bushing with a lip at one end for engaging behind the bushing. A wedge member actuated by an elongate bolt forces the lip outwardly into engagement. A screw threaded portion of the outer surface of the puller body carries a nut which can drive a sleeve shaped outer puller axially along the inner puller body to engage an outer member carrying the bushing. An installing tool is also provided including a cylindrical portion for insertion into the bore of a bushing and a shoulder at the end of that portion for engaging the end surface of the bushing so that hammer blows applied to one end of the tool force the bushing into place.

17 Claims, 4 Drawing Figures

EXTRACTOR TOOL FOR BEARINGS, BUSHINGS AND THE LIKE

BACKGROUND OF THE INVENTION

This invention relates to an extractor tool for bearings, bushings and the like and is particularly but not exclusively designed for use with a spherical bushing (uni-ball) from the outward shaft of the rotor drive gearbox of a combine.

At present, one has to remove gearboxes before removing spherical bushing (uni-ball) with a slide hammer puller. When this method is used and is unsuccessful in removing spherical bushing (uni-ball), 90% of dealerships use a cutting torch, therefore running the risk of damaging the output shaft, plus overheating of this shaft could cause shaft and seal failure. This method takes approximately 8–9 hours. If the gearboxes are left in the combine, the slide hammer puller cannot be used because there is no room to work with it. Some dealerships move the rotors forward enough or completely remove and then use a cutting torch, running the risk of internal fire in the combine and probable damage to output shaft and gearbox seal. Approximate time 3½–4 hours. If seal failure does exist, gearboxes have to be pulled from the combine for seal replacement.

Various designs of puller devices have been located in a search as follows:

U.S. Pat. No. 2,847,752 discloses a valve lifter extractor but this is unsatisfactory for the purpose for which the present invention is concerned for the following reasons:

1. Relies on hand pull power which does not provide necessary force to extract the spherical bushing.
2. Cannot be used in confined area.
3. Does not provide depth required; therefore, would not grip the bushing.
4. Does not provide backing against gear box to relieve the stress.

U.S. Pat. No. 2,671,263 discloses an extractor tool for bearings and bushings, but this is unsatisfactory for the following reasons:

1. Relies on barbed ends for friction grip on the hard steel surface, inside of the spherical bushing, which would not provide the necessary grip for extraction.
2. Uses a finger turn head for the expansion pressure which would not provide sufficient outer force for grip to pull out the spherical bushing.
3. Rotating handles would be too short in confined areas to exert necessary force or torque for removal of a spherical bushing.
4. Only hand pressure can be used to keep the whole unit from rotating while attempting to remove a spherical bushing.
5. All parts must be machined thus creating greater manufacturing cost.

U.S. Pat. No. 1,496,134 discloses a tool for extracting expansion bolts, but this is unsatisfactory for the following reasons:

1. Depends on hand pull which would not provide the necessary force to remove a spherical bushing.
2. Extraction tongs do not provide the necessary grip for extraction force.
3. Cannot be used in limited space area.
4. Gear box needs to be tightly secured because there is no backing force applied against the gear box.

U.S. Pat. No. 1,363,934 discloses a journal box or flue puller, but this is unsatisfactory for the following reasons:

1. Relies on hand pull or chain to exert pulling force which would not be possible in a confined area.
2. Depends on a rat-tail grip pattern on the extracting portion of the puller which would not provide the necessary grip for extraction.
3. Difficult to exert pulling force when having to ensure the wedge pressure is secure at the start.

U.S. Pat. No. 3,052,973 discloses a tool for removing bushings, but this is unsatisfactory for the following reasons:

1. The barbed grip end of the extraction unit would not be able to provide sufficient grip friction to remove hard steel spherical bushings.
2. Use of a fixed rotating handle of sufficient length to provide torque necessary for removal would not be operable in a confined area.
3. The stand assembly makes it impossible to manoeuver in confined areas when gear box is not removed from the implement.
4. The coil spring retainer would limit the depth size of spherical bushings that could be removed.
5. The nut to expand the barbed unit is a hand turn which would not provide enough torque to provide expansion force necessary for removal.
6. All parts must be especially machined making the cost expensive.
7. The unit that the bushing is being removed from must be supported up for the tool.

U.S. Pat. No. 2,290,427 discloses a bearing puller, but this is unsatisfactory for the following reasons:

1. The concave lip of the expansion unit does not grip enough to remove the spherical bushing.
2. The expansion unit is not slotted enough to provide maximum surface contact of the gripping lip to hold onto the bushing.
3. Depends totally on a dead end unit to provide a pushing surface for extracting bolt to push against and would be too long for most jobs in a confined area.
4. The double wedge system puts side pressure on the inner portion of the bushing thus expanding the outer portion and making it tighter; thus, removal is more difficult.

U.S. Pat. No. 4,207,664 discloses a pulling tool for extracting bushings and bearings, but it is unsatisfactory for the following reasons:

1. This unit is limited to extracting bushings from dead end units and will not work with open ended set ups.
2. Difficult to keep the expansion unit in position with the threads aligned while installing the extraction bolt in a confined area.
3. The wedge-type extraction bolt exerts horizontal and vertical pressure on the threads of the extraction bolt thus increasing the amount of torque necessary which would be difficult to supply with an Allen wrench.

It is one object of the present invention, therefore, to provide an improved extractor tool or pulling device for bearings, bushings and the like which is designed in an improved manner to provide the necessary pulling force and to provide the necessasry grasping technique on the bearing sleeve to which the force is to be applied.

According to the invention, therefore, it is provided an extractor tool for bearings, bushings and the like having a bore within which a shaft is normally received, the tool comprising an inner puller body which has a substantially cylindrical outer surface and an inner bore extending axially therealong, one end of the body including integrally therewith a grasping portion having an outer surface thereof which is substantially cylindrical for entering said bore and includes a substantially radially extending lip defined by a shoulder facing toward an opposed end of the body and including a plurality of longitudinal slots dividing said grasping portion into a plurality of grasping members each of which can flex outwardly to cause said lip to engage behind a rear face of said bearing, bushing or the like, a bolt for extending along said inner bore having a head at one end for engaging an end face at said opposed end of said inner puller body and a male screw threaded portion at an opposed end thereof arranged, with said head at said opposed end, to extend outwardly at said one end of the body, a wedge member having a female screw thread therein such that rotation of the bolt relative to the wedge member causes the wedge member to be drawn axially to engage an inside surface of said grasping portion to flex said grasping members outwardly, a portion of the outer surface of said inner puller body having thereon a screw thread, a nut for engaging said screw thread so as to move axially when the nut is rotated relative to said body, means on said body by which the body can be grasped for holding said body against rotation, and an outer puller body having an inner surface arranged to surround said screw thread portion of the outer surface, one end surface for engaging said nut for axial movement of the outer puller body with the nut and an opposed end face spaced from the inner puller body for engaging an abutment whereby rotation of said bolt causes said grasping portion to grasp an inner face of said bushing, bearing and the like and rotation of said nut causes said outer puller body to engage said abutment and to force said inner puller body and said bearing, bushing and the like in axial direction for removal.

With the foregoing in view, and other advantages as will become apparent to those skilled in the art to which this invention relates as this specification proceeds, the invention is herein described by reference to the accompanying drawings forming a part hereof, which includes a description of the best mode known to the applicant and of the preferred typical embodiment of the principles of the present invention, in which:

DESCRIPTION OF THE DRAWINGS

In the drawings like characters of reference indicate corresponding parts in the different figures.

DETAILED DESCRIPTION

A bushing is indicated schematically at 10 mounted within a body 11 with the shaft on which the bushing sits already removed leaving the hollow bore of the bushing indicated at 12.

Figure 1:
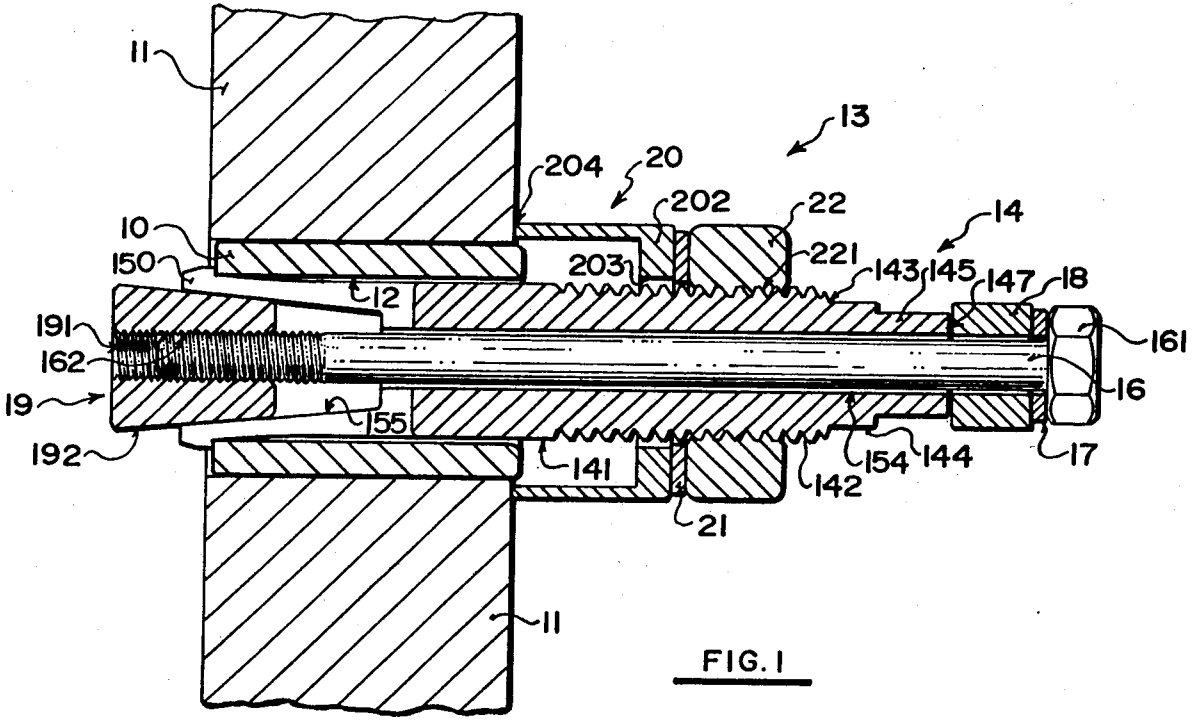
FIG. 1 is a cross-sectional view of an extraction tool according to the invention in operation.
Figure 2:
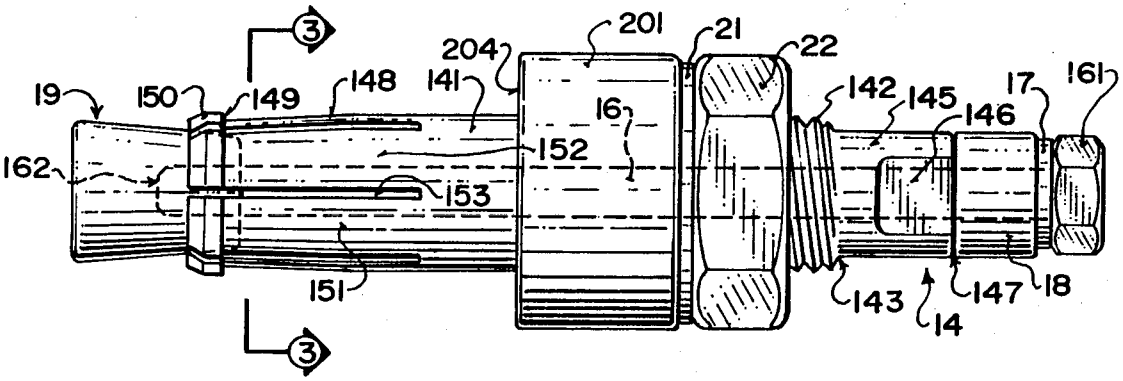
FIG. 2 is a side elevational view of the tool of FIG. 1.

The puller for the bushing is generally indicated at 13. The puller device is formed from a number of separate parts. Firstly, there is an inner puller body indicated at 14. The inner puller body comprises an integral body which is generally cylindrical in shape defining an outer cylindrical peripheral surface 141 of a diameter substantially equal to the diameter of the inner surface 12 of the bushing. Part of the cylindrical surface carries a screw thread 142 which extends from a shoulder 143 along the peripheral surface toward a left-hand end as shown in FIG. 1. The shoulder 143 defines a reduction in diameter of the peripheral surface down to a second surface 144 with a further reduction in diameter providing a surface 145 which carries a pair of flats 146 by which the inner puller body can be grasped and held against rotation. An end of the inner puller body at the right-hand end of the surface 145 is indicated at 147.

The lefthand end of the inner puller body is machined to taper slightly inwardly over an area indicated at 148 down to a lip or shoulder 149 which faces in a righthand direction as shown in FIG. 1. The lip or shoulder is provided by a rib 150 at the lefthand end. The section 148 is divided into 6 separately flexible parts 151, 152, etc., by slots 153 which extend longitudinally and are equidistantly spaced around the axis of the inner puller body. A central bore extends along the full length of the inner puller body as indicated at 154 from the righthand end through to the lip 150. An inne surface of the section 148 is machined to define a wedge shape 155 which converges from a widest end at the lip 150 toward the bore 154 at the end of the flexible pieces 151, 152. Thus the radial thickness of each of the pieces 151, 152 is reduced at the outermost end adjacent the lip 150 so as to allow flexibility of those portions. The whole of the inner body is manufactured from a suitable steel so that the portions 151, 152 can flex and can return to their initial shape after the flexing force is removed.

A central bolt 16 carries a hex head 161 for engaging against a washer 17 and a sleeve 18 so as to apply pressure to the end 147 of the inner puller body. The end of the bolt 16 remote from the head 161 includes a male screw thread 162 for cooperating with a female screw thread 191 of a wedge member 19. The wedge member 19 has an outer surface 192 which substantially conforms to the inner surface 155 of the inner puller body so that axial movement of the wedge member 19 acts to deform or flex the portions 151, 152 outwardly. Axial movement of the wedge member 19 is obtained by rotation of the head 161 so as to engage the screw threads 162 and 191.

In a first operation of the device, therefore, with the wedge member 19 attached to the bolt 16 but remote from the lip 150, the inner puller body can be inserted through the bore 12 of the bushing to a position where the lip 149 extends behind the rear edge of the bushing. In this position, the bolt 16 is rotated to draw the wedge member into the end of the inner puller body so as to force the portions 151 and 152 outwardly to engage the lip against a rear surface of the bushing. During the initial rotation to obtain necessary engagement, manual movement of the inner puller body can be provided to ensure that the engagement is properly aligned.

An outer puller body 20 comprises a sleeve 201 welded on a radial plate 202, the latter having a central bore 203 by which it can slide over the outer surface 141 of the inner puller body including over the screw thread 142. The diameter of the sleeve 201 is such that an end face 204 thereof can engage around the outside of the bushing 10 onto the body 11. A washer 21 is shaped to engage against an end face of the radial plate 202 and also includes a central bore to allow it to move with the outer puller body. A large hex nut 22 of the same general size as the outer surface of the puller body 20 includes an outer hex surface by which it can be grasped by a suitable large wrench or socket and an inner screw thread 221 by which it can engage the screw thread 142 so that rotation of the nut drives the outer puller body axially along the inner puller body.

Thus, relative movement can be obtained between the lip 149 and the edge 204 by rotation of the nut 22 to cause relative movement between the bushing 10 and the body 11 to extract the bushing. On a very hard pull when the spherical bushing 10 is firmly in place, the inner puller body may want to rotate and hence the flats 146 can be engaged by a suitable tool to prevent that rotation. The rotation of the nut 22 is continued unitl the spherical bushing is inside the outer puller body.

It will be noted that the rotation of the nut 22 does not in any way affect the position of the wedge member 19 and accordingly does not apply increased force in the area of the wedge member and flexible portions 151, 152 after those parts have been moved to the requirement clamping position.

The following points of this device are of particular importance:

1. Can be used for removing roller bearings, bushings of soft or hard steel.
2. Can be used for removing the same from open ended or dead end units.
3. Provides good working depth for removing spherical bearings.
4. Uses a large hexagon nut threaded on the inner extracting unit, pushing against the outer puller body providing extreme pulling power.
5. Has two flats on the inner extracting unit where an open ended wrench can be used to keep the whole unit from turning.
6. Provides backing against the gear box to relieve stress from the pull.
7. Can be used in a confined area without removing gear box from implement.
8. Once inner extracting unit is tightened in place, any torque applied to the extracting hexagon nut does not increase outward pressure (expanding the spherical bushing). All the force is used to pull it out.
9. The gripping lip of the slotted expansion portion of the inner extracting unit provides secure grip on the edge of the inner part of the spherical bushing.
10. The six slotted segments of the inner extracting expansion unit provide greater contact area for the gripping lip on the inner edge of the spherical bushing.
11. Being made out of spring steel, the slotted expansion unit returns to original size after the spherical bushing is removed and the wedge is released.
12. The spherical bearing puller can be installed in one unit and holds itself in place after the wedge is tightened and will remain secure.
13. The brass washer between hexagon nut and outer pulling body cuts down on the friction utilizing less torque to remove the bushing.
14. Out of the eight pieces, only two require special machining. Therefore, the cost of manufacturing is greatly reduced.
15. Three pieces can be purchased from the local stores for replacements.

Figure 4:
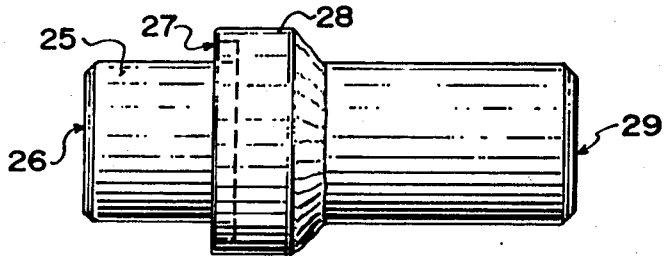
FIG. 4 is a side elevational view of an installation tool for use in association with the extraction tool.
Figure 3:
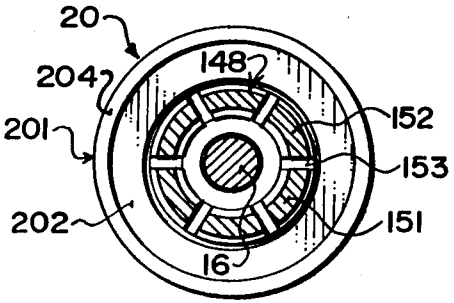
FIG. 3 is a cross-sectional view on the lines 3—3 of FIG. 1.

In FIG. 4 is shown an installer body which comprises a cylindrical shaft portion 25 having an end 26 and an outside diameter substantially equal to the inner diameter 12 of the bushing. A shoulder 27 is provided at the end of the portion 25 remote from the end 26 and formed on one end of an increased diameter portion 28. The shoulder 27 therefore can engage one end face of the bushing with the portion 25 inside the bore 12 thereof. A transverse end 29 is defined on the body remote from the end 26 for receiving hammer blows so that the shoulder 27 guided by the portion 25 acts to drive the bushing into its required place within the body 11. If a bushing of this type is installed using only a hammer, damage can occur to the centre of the spherical bushing causing a wedging effect.

The cylindrical shaft portion 25 also has a quarter inch hole throughout the shaft (end to end), allowing for easier installation in a dead end housing, thus not trapping any air.

Since various modifications can be made in my invention as hereinabove described, and many apparently widely different embodiments of same made within the spirit and scope of the claims without departing from such spirit and scope, it is intended that all matter contained in the accompanying specification shall be intepreted as illustrative only and not in a limiting sense.

I claim:

1. An extractor tool for bearings, bushings and the like having a bore within which a shaft is normally received, the tool comprising an inner puller body which has a substantially cylindrical outer surface and an inner bore extending axially therealong, one end of the body including integrally therewith a grasping portion having an outer surface thereof which is substantially cylindrical for entering said bore and includes a substantially radially extending lip defined by a shoulder facing toward an opposed end of the body and including a plurality of longitudinal slots dividing said grasping portion into a plurality of grasping members each of which can flex outwardly to cause said lip to engage behind a rear face of said bearing, bushing or the like, a bolt for extending along said inner bore having a head at one end and a male screw threaded portion at an opposed end thereof arranged, with said head at said opposed end of said inner puller body, to extend outwardly at said one end of the body, a spacer sleeve between said opposed end of said inner puller body and said head and an outer washer between said spacer sleeve and said head, a wedge member having a female screw thread therein such that rotation of the bolt relative to the wedge member causes the wedge member to be drawn axially to engage an inside surface of said grasping portion to flex said grasping members outwardly, the wedge member having a small end larger than the inner bore of the inner puller body, a portion of the outer surface of said inner puller body having thereon a screw thread, a nut for engaging said screw thread so as to move axially when the nut is rotated relative to said body, holding means on said body by which the body can be grasped for holding said body against rotation, an outer puller body having an inner surface arranged to surround said screw thread portion of the outer surface, an inner washer arranged to surround the screw thread portion of the outer surface between the nut and the outer body, for engaging one end surface of said outer puller body and said nut for axial movement of the outer puller body with the nut and an opposed end face spaced from the inner puller body for engaging an abutment whereby rotation of said bolt causes said grasping portion to grasp an inner face of said bushing, bearing and the like and rotation of said nut causes said outer puller body to engage said abutment and to force said inner puller body and said bearing, bushing and the like in axial direction for removal.

2. The invention according to claim 1 wherein said grasping members are manufactured from spring steel whereby removal of the wedge member causes the grasping members to retract radially inwardly to release said bearing, bushing and the like.

3. The invention according to claim 1 wherein said grasping portion has greater than four slots equidistantly angularly spaced around the axis such that each of said grasping members effectively grasps a portion of said rear face.

4. The invention according to claim 1 wherein said outer puller body comprises a cylindrical sleeve coaxial with and surrounding said inner puller body and a radial end plate member attached to said sleeve, said radial end plate member having an opening therein coaxial thereto and of a size such that it is a loose fit on the screw threaded portion of the inner puller body.

5. The invention according to claim 1 wherein said holding means comprises a pair of opposed flats on said outer surface of said inner puller body and arranged between said opposed end and said screw thread portion.

6. The invention according to claim 1 wherein each of the grasping members includes an inner surface which is inclined to the axis so as to define a wedge surface for cooperating with a similarly shaped outer surface of the wedge member.

7. The invention according to claim 1 including an installer device comprising a shaft member of cylindrical outer surface with a diameter substantially equal to the diameter of said grasping portion whereby said shaft member can slide inside said bore and a surrounding collar member defining a shoulder facing axially of the shaft member for engaging an end face of said bearing, bushing and the like.

8. The invention according to claim 2 wherein said grasping portion has greater than four slots equidistantly angularly spaced around the axis such that each of said grasping members effectively grasps a portion of said rear face.

9. The invention according to claim 8 wherein said outer puller body comprises a cylindrical sleeve coaxial with and surrounding said inner puller body and a radial end plate member attached to said sleeve, said radial end plate member having an opening therein coaxial thereto and of a size such that it is a loose fit on the screw threaded portion of the inner puller body.

10. The invention according to claim 8 wherein said holding means comprises a pair of opposed flats on said outer surface of said inner puller body and arranged between said opposed end and said screw thread portion.

11. The invention according to claim 8 wherein each of the grasping members includes an inner surface which is inclined to the axis so as to define a wedge surface for cooperating with a similarly shaped outer surface of the wedge member.

12. The invention according to claim 8 including an installer device comprising a shaft member of cylindrical outer surface with a diameter substantially equal to the diameter of said grasping portion whereby said shaft member can slide inside said bore and a surrounding collar member defining a shoulder facing axially of the shaft member for engaging an end face of said bearing, bushing and the like.

13. The invention according to claim 4 wherein said holding means comprises a pair of opposed flats on said outer surface of said inner puller body and arranged between said opposed end and said screw thread portion.

14. The invention according to claim 13 wherein each of the grasping members includes an inner surface which is inclined to the axis so as to define a wedge surface for cooperating with a similarly shaped outer surface of the wedge member.

15. The invention according to claim 13 including an installer device comprising a shaft member of cylindrical outer surface with a diameter substantially equal to the diameter of said grasping portion whereby said shaft member can slide inside said bore and a surrounding collar member defining a shoulder facing axially of the shaft member for engaging an end face of said bearing, bushing and the like.

16. The invention according to claim 3 wherein each of the grasping members includes an inner surface which is inclined to the axis so as to define a wedge surface for cooperating with a similarly shaped outer surface of the wedge member.

17. The invention according to claim 16 including an installer device comprising a shaft member of cylindrical outer surface with a diameter substantially equal to the diameter of said grasping portion whereby said shaft member can slide inside said bore and a surrounding collar member defining a shoulder facing axially of the shaft member for engaging an end face of said bearing, bushing and the like.

* * * * *